US007111841B2

(12) United States Patent
Jacobs et al.

(10) Patent No.: US 7,111,841 B2
(45) Date of Patent: Sep. 26, 2006

(54) MECHANISM FOR ADAPTING CASSETTE GUIDE MOVEMENT FOR SIZE DETECTION

(75) Inventors: Jos W. Jacobs, Tigard, OR (US); Fred T. Mattern, Portland, OR (US); Paul Marttila, Toronto (CA)

(73) Assignee: Xerox Corporation, Stamford, CT (US)

( * ) Notice: Subject to any disclaimer, the term of this patent is extended or adjusted under 35 U.S.C. 154(b) by 223 days.

(21) Appl. No.: 10/740,470

(22) Filed: Dec. 22, 2003

(65) Prior Publication Data

US 2005/0133983 A1 Jun. 23, 2005

(51) Int. Cl.
*B65H 1/00* (2006.01)

(52) U.S. Cl. ..... 271/171

(58) Field of Classification Search ..... 271/171; 403/256, 257, 331, 329, 326
See application file for complete search history.

(56) References Cited

U.S. PATENT DOCUMENTS

| | | | | | |
|---|---|---|---|---|---|
| 4,579,333 | A | * | 4/1986 | Aoki | 271/162 |
| 4,697,803 | A | * | 10/1987 | Kan et al. | 271/127 |
| 4,786,042 | A | * | 11/1988 | Stemmle | 271/9.1 |
| 5,190,280 | A | * | 3/1993 | Gray et al. | 271/171 |
| 5,333,852 | A | | 8/1994 | Milillo et al. | |
| 5,511,771 | A | | 4/1996 | Rubscha | |
| 5,596,399 | A | | 1/1997 | Dempsey et al. | |
| 5,655,764 | A | * | 8/1997 | Ota et al. | 271/171 |
| 5,706,672 | A | * | 1/1998 | Miyazaki | 62/427 |
| 5,927,707 | A | * | 7/1999 | Miura | 271/171 |
| 6,003,862 | A | | 12/1999 | Russell et al. | |
| 6,126,356 | A | * | 10/2000 | Russell | 403/24 |
| 6,254,085 | B1 | * | 7/2001 | Kang | 271/171 |
| 6,829,964 | B1 | * | 12/2004 | Dufendach | 74/523 |
| 2002/0080426 | A1 | * | 6/2002 | Ito | 358/498 |

FOREIGN PATENT DOCUMENTS

| | | | |
|---|---|---|---|
| JP | 62-201735 | * | 9/1987 |
| JP | 6-127704 | * | 5/1994 |

OTHER PUBLICATIONS www.engr.utexas.edu/dteach/Experience/forces/brief.htm, Oct. 2002.*

* cited by examiner

*Primary Examiner*—Gene Crawford
*Assistant Examiner*—Thomas A. Morrison
(74) *Attorney, Agent, or Firm*—Oliff & Berridge, PLC

(57) ABSTRACT

Systems and methods for adapting cassette guide movement for size detection includes, in exemplary embodiments, a one-piece member that transmits and rotates a movement of a guide member placed on a side of a sheet to a sheet size detector that detects a position of the guide member, wherein a first end of the connector is connected to the guide member and the second end of the connector is connector is connected to the sheet size detector.

16 Claims, 4 Drawing Sheets

MECHANISM FOR ADAPTING CASSETTE GUIDE MOVEMENT FOR SIZE DETECTION

BACKGROUND OF THE INVENTION

1. Field of Invention

The invention relates to systems and methods for adapting cassette guide movement for size detection.

2. Description of Related Art

Adjustable sheet cassettes supply sheets that are stacked in an reproduction system, for example, copiers, printers, facsimile machines, etc. Typically in these systems, individual sheets of copy paper are separately fed through the reproduction system and are processed one at a time. It is thus convenient to have a supply of sheets from which individual sheets are fed.

A reproduction system must be able to accurately reproduce original documents of various sizes or configurations on various types of copy stock. To facilitate this operational flexibility, it has been customary to provide a supply of cut sheets in a cassette-type or cassette form. These sheet cassettes may be designed for a single fixed size of paper in which case they are only used for storing sheets of that size in the reproduction system. Alternatively, adjustable cassettes may be designed to enable customer adjustment of the cassette for a variety of different sheet sizes.

With the fixed size cassette, if a printing operation is to be performed to obtain prints on a copy sheet size of a size other than that which is in the fixed cassette, the cassette must be removed from the machine and replaced with another cassette of a different fixed size to enable the operation to be completed. Similarly, with an adjustable cassette, if the size of the paper in the cassette is unsuitable for a particular printing operation, the copy sheets should be removed and replaced with the appropriate size copy sheets for that particular printing operation.

SUMMARY OF THE INVENTION

It is desirable that the reproduction system know the size of the sheets in the cassette as soon as it is inserted in the reproduction system. This enables the machine to automatically provide feedback so that an operator can determine if a particular job can be run with the sheet size in the cassette or if the sheet supply must be replaced. With a copier, for example, it enables the operator to determine if the machine is capable of providing size for size reproduction or automatic reduction and/or automatic enlargement of an original that may be placed on the copying platen.

Sheet size sensing is usually technically not very difficult. However, it is difficult to develop an economical way to reliably sense multiple sheet sizes. Often, with the larger, expensive reproduction systems, the size of each sheet is determined as the sheet is fed through the reproduction system. However, this approach is rather expensive. Smaller, less expensive reproduction systems typically do not need to sense multiple sizes. These reproduction system do not allow the user to use multiple sizes or only allow for only two different sizes. Flexibility is thus compromised.

In yet other reproduction systems, cassette guide positions are used to detect the sheet size in the cassette. Typically, a number (n) of discrete digital on-off sensors or switches detect $2^n$ different guide positions. These reproduction systems use elaborate electromechanical systems to adapt the guide position for size sensing detection. These systems are complicated mechanisms consisting of sliders, gears, levers, cams, disks, or even pulleys, belts and cables. These systems are also limited in capability, are expensive and are not user friendly.

There is thus a constant need to simplify sheet size sensing, improve the reliability of sheet size sensing while reducing the manufacturing costs involved in developing a sheet size sensing mechanism, and to make the sheet size sensing more user friendly.

Because of this, there is a need for systems and methods that can reduce the cost of the sheet size sensing mechanism by reducing the number of mechanical components.

There also is a need for systems and methods that improves the reliability of the sheet size sensing mechanism by reducing the mechanical play created between a sheet guide and sensor or switch that detects a position of the sheet guide.

There is also a need for systems and methods that improve the flexibility of a sheet size sensing mechanism by making the mechanism less dependent on actual cassette geometry.

The systems and methods of this invention adapt the sheet guide position of a removable cassette for conventional sheet size detection with a number of digital on-off sensors or switches.

The systems and methods of this invention separately allow for cost effective sheet size determination in a reproduction system.

The systems and methods of this invention separately define the mechanical interface between the cassette guide position and size detecting sensors or switches in the reproduction system.

The systems and methods of this invention separately use a single mechanical part to transmit the motion from a side guide to a slide plate.

The systems and methods of this invention separately improve reliability by using a single part to transmit motion from a guide member to a slide plate.

The systems and methods of this invention separately improve accuracy by eliminating substantially all detrimental part tolerances that are the result of using multiple components.

The systems and methods of this invention separately improve accuracy by eliminating substantially all of the relative motion between the guide member and the slide plate.

The systems and methods of this invention separately translate and rotate a guide motion of a guide member.

The systems and methods of this invention separately translate and rotate a guide motion of a guide member using a rod supported in a channel of a cassette.

The systems and methods of this invention separately translate and rotate a guide motion of a guide member using a rod that connects the cassette guides with a slider that can easily interact with the sensor or switch array.

Exemplary systems of this invention may include a sheet cassette including a guide member that is placed on a side of a sheet and is movable between a first position and a second position, a sheet size detector that detects a position of the guide member and is movable between a third position and a fourth position and a one-piece connector with two ends, wherein a first end of the connector is connected to the guide member and a second end of the connector is connected to the sheet size detector.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described with reference to the following figures, wherein.

DETAILED DESCRIPTION OF EXEMPLARY EMBODIMENTS

Figure 1:
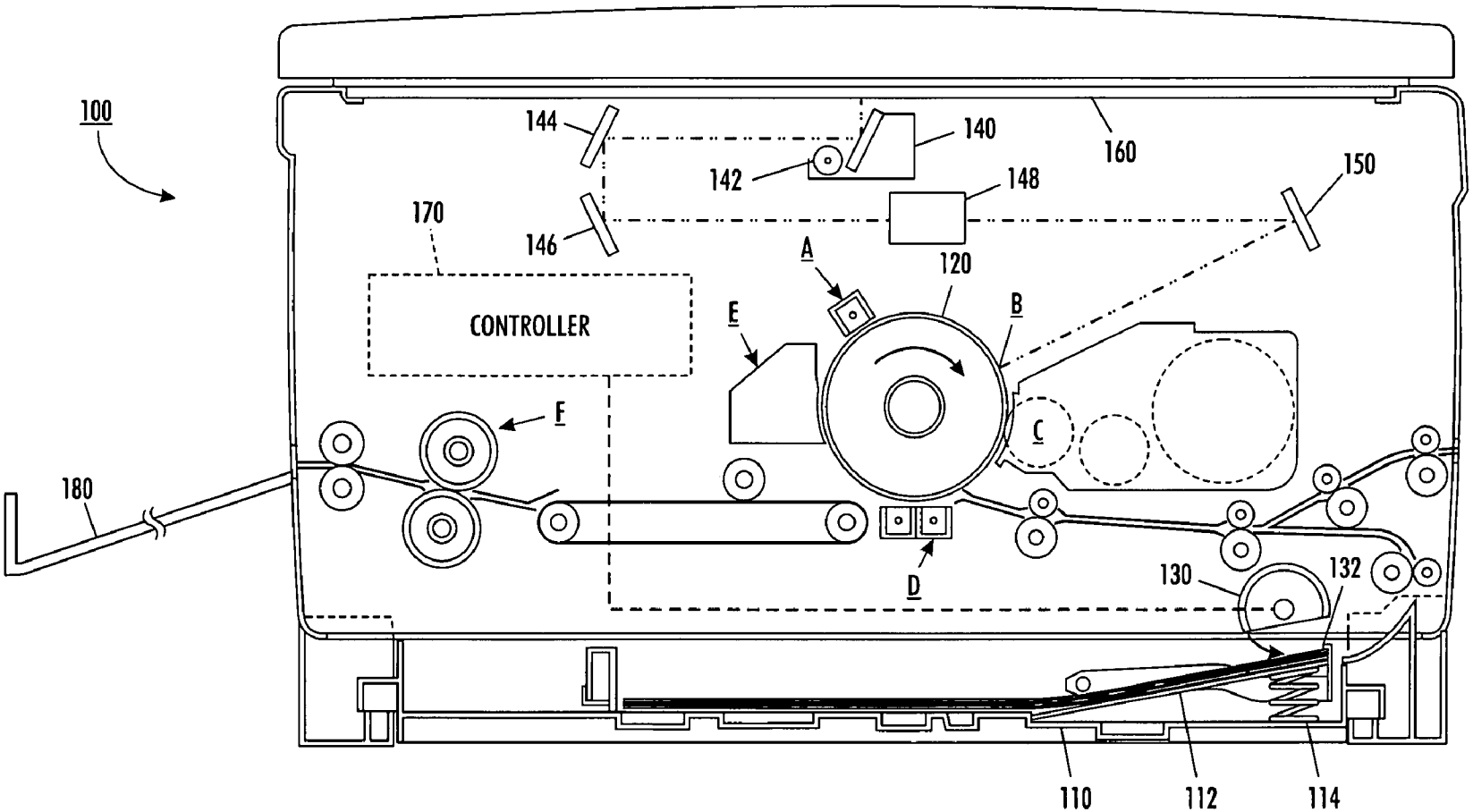
FIG. 1 is a schematic representation of an automatic printing machine having a sheet cassette according to an exemplary embodiment of this invention.

For a general understanding of an electro photographic printer, solid ink printer or copying machine (i.e., reproduction system) in which the features of this invention may be incorporated, reference is made to FIG. 1, which depicts schematically various key components thereof. Although this invention for accurately adapting a cassette for size detection is particularly well adapted for use in such a machine, it should be apparent that this embodiment is merely illustrative. Rather, aspects of this invention may be achieved in any cassette in which a broad number of substrate or media types need to be registered and identified in a precise, accurate manner.

Referring initially to FIG. 1, there is shown an automatic xerographic printing machine 100 including the adjustable sheet cassette 110, according to the present invention. Although the present invention is particularly well suited for use in automatic xerographic apparatus, it is equally well adapted for use with any number of other devices in which cut sheets of material are fed from a sheet supply source. The printer includes a photosensitive drum 120 which is rotated in the direction indicated by the arrow to pass sequentially through a series of xerographic processing stations; a charging station A, an imaging station B, a developer station C, a transfer station D and a cleaning station E.

A document to be reproduced is placed on imaging platen 160 and scanned by moving optical system 140 including a lamp 142, mirrors 144, 146 and 150 and lens 148 to produce a flowing light image on the drum surface which had been charged at charging station A. The image is then developed at development station C to form a visible toner image. The adjustable sheet cassette 110 according to the present invention is inserted from the front of the machine into the plane of FIG. 1 in the direction illustrated by arrow 104 in FIG. 2. The stack of sheets is supported in the cassette 110 by sheet stack support platform 112 which is urged upwardly by a lift motor 114 toward the feed roll 130. The feeding of sheets is actuated by the controller 170 to feed a sheet from the cassette 110 to registration rolls in synchronous relationship with the image on the drum surface to the transfer station D. Following transfer of the toner image to the copy sheet, the copy sheet is stripped from the drum surface and directed to the fusing station F to fuse the toner image on the copy sheet after which the drum surface itself continues to the cleaning station E where residual toner remaining on the drum surface is removed prior to the drum surface again being charged at charging station A. Upon leaving the fuser, the copy sheet with the fixed toner image thereon is transported to sheet collecting cassette 180.

Referring more particularly to FIGS. 2–5, the automatic sheet size sensing mechanism will by discussed in greater detail. The cassette 110 illustrated in FIGS. 2, 3 and 5 has had the sheet support platform 112 and the lift motor 114 removed to facilitate a better understanding of the automatic sheet size sensing mechanism used in the cassettes. Typically, the cassette or drawer bottom is of a one-piece molded plastic, which has additional plastic features incorporated therein or added thereto including, for example, a rear frame member and side frame members 116 and 118.

When a stack of sheets is placed on the sheet support platform 112, a rear sheet edge guide 200 is moved into position in order to contact the rear edge of the sheets. The rear sheet edge guide 200 rides in a mounting slot 402 and two series of slots 404, 406 and has at its inboard end a pressure locking member 408 to hold it in place against the rear edge of the stack of sheets. Center registration of all documents can be conventionally provided by a well-known dual rack and pinion connection 210 of opposing side guides 212, 214 of the cassette 110. The side guides 212, 214 thus automatically move together towards or away from one another by the same amount, so as to center the sheet stack irrespective of the size of the loaded sheets. As with the rear sheet edge guide 200, the opposing side guides 212, 214 can also include a locking member that holds the opposing side guides 212, 214 in place. As should be appreciated, only center registered guides 212 and 214 are shown. However, non-center registered guides can be used.

In order to adapt the printing mechanism 100 to multiple sheet sizes, the size of the sheets must be detected. The size of the sheets must be detected in order to avoid printing outside of the intended printing area or to utilize all of the printing area. As should be appreciated with solid ink printers, ink that is not transferred to the sheet remains in the printing mechanism 100 where damage to the printing mechanism 100 or future prints may occur. As such, a sheet size detection apparatus determines the size of the sheet and an actuator accurately positions the sheet size detection apparatus.

Figure 2:
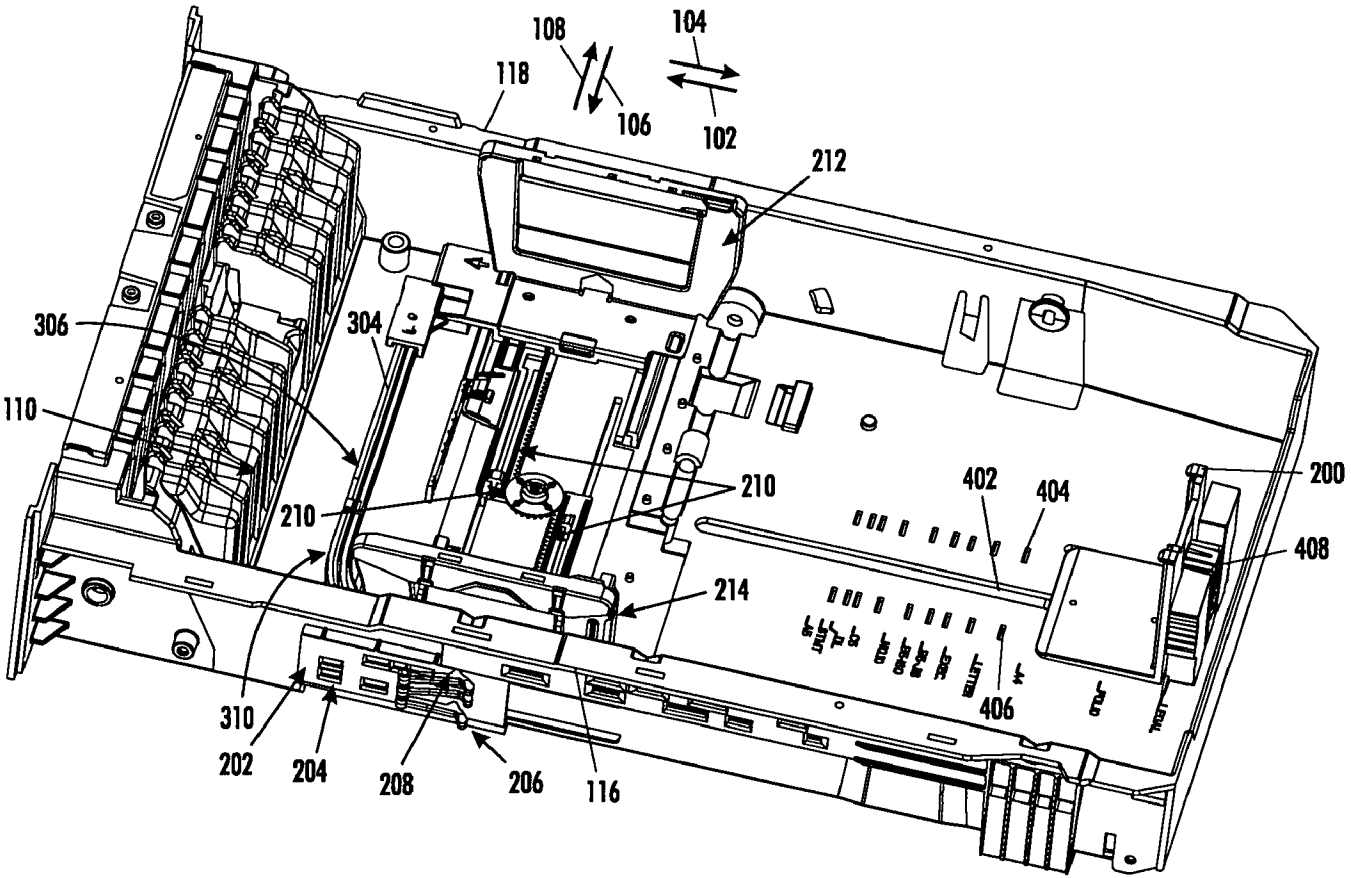
FIG. 2 shows a three dimensional view showing in detail the sheet cassette according to the exemplary embodiment of this invention.

The sheet size detection apparatus utilizes the position of the opposing side guides 212, 214 in order to activate size detecting sensors or switches in the printing mechanism 100. It is sufficient to use only one of the opposing side guides 212, 214 for size detection because the side guides 212, 214 are connected together by the rack and pinion connection 210 and therefore move symmetrically. However, as should be appreciated, the position of the rear sheet edge guide 200 can be used. As shown in FIG. 2, the sheet size detection apparatus includes a slide plate 202, holes 204, arms 206 and cams 208. The slide plate 202 moves in the direction indicated by the arrows 102, 104 by a mounting slot integral with or attached to the side frame member 116.

Figure 5:
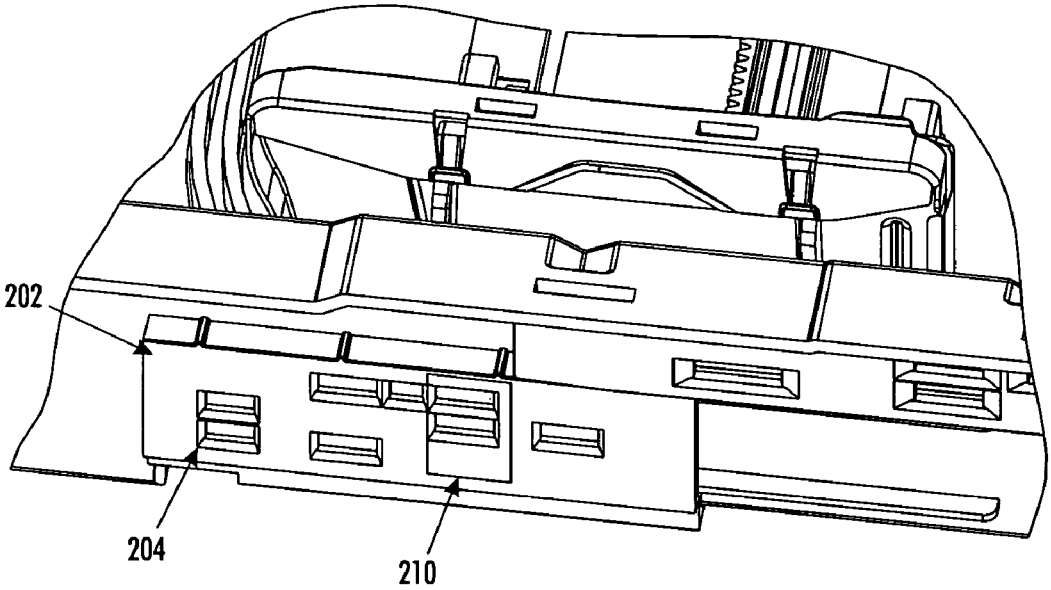
FIG. 5 shows a three dimensional view showing in detail the sheet cassette with the slide plate according to the exemplary embodiment of this invention.

Attached to or integral with an outside surface of the side frame member 116 are the cams 208. Attached to or integral with an outside surface of the cams 208 are the arms 206 with one arm 206 attached to each cam 208. The cams 208 and the arms 206 remain fixed relative to the side frame member 116 in the direction indicated by the arrows 102, 104. However, the cams 208 move the arms 206 in the direction indicated by the arrow 106 through the various holes 204 of the slide plate 202 and maintains the arms 206 in an extended position when the arms 206 are placed adjacent to the holes 204. As such, as shown in FIG. 5, a mechanical pattern can be created by the arms 206 extending through the holes 204 as indicated by the solid line 210, for example, to indicate a position of the side guides 212, 214. Conversely, the arms 206 move the cams 208 in the direction indicated by the arrow 108 outside of the various holes 204 of the slide plate 202 and maintains the cams 208 in a retracted position when the arms 206 are not placed adjacent to the holes 204.

In various other exemplary embodiments, the arms 206 used to extend through the holes 204 should be curved in order to permit the arms 206 to sequentially be transported in and out of the holes during the cassette 110 insertion and withdrawal procedure. By so rounding the ends of the individual arms 206, damage to the individual arms 206 on insertion and withdrawal is avoided.

As shown in FIG. 5, the holes 204 are formed in the slide plate 202 so that the arms 206 and cams 208 can selectively interact with flags that activate sensors or switches of a circuit board (not shown) that is permanently fixed to the main body of the printing apparatus 100. Although a cam/actuator spring assembly is described, it should be appreciated that an optical array, hall effect sensor array or any other sensor system can be used to transmit data regarding the position of the side guide 212. Once the slide plate 202 is in the proper position and the appropriate arms 206 contact the appropriate flags, the flags then activate the sensors or switches of the circuit board.

By activating a given number and sequence of sensors or switches, the controller 170 can then determine the correct sheet size out of a plurality of sheet sizes. As such, the controller 170 can interpret the size of the sheet loaded in the cassette 110 based on the sequence of sensors or switches rather than using continuous size sensing. Interpreting the size of the sheet loaded in the cassette 100 based on the sequence of the sensors and switches is known and discussed, for example, in U.S. Pat. No. 5,596,399 to Dempsey et al. and U.S. Pat. No. 5,333,852 to Milillo et al., which are incorporated herein by reference in their entirety.

However, in order to align the arms accurately into the appropriate holes conventionally, the position of the side guides are used. When the sheets are placed in the cassette, the side guides are adjusted to fit the sheet width. In adjusting the side guides, a plurality of sliders, gears, cams, levers, belts and cables where used to move the slide plate in order to correspond to a movement of opposing side guide members. The plurality of components thus increase manufacturing costs because a large number of parts have to be created. Also, a lot of play is created because the numerous components are used. Positioning accuracy of the holes relative to the arms is thus compromised.

Figure 3:
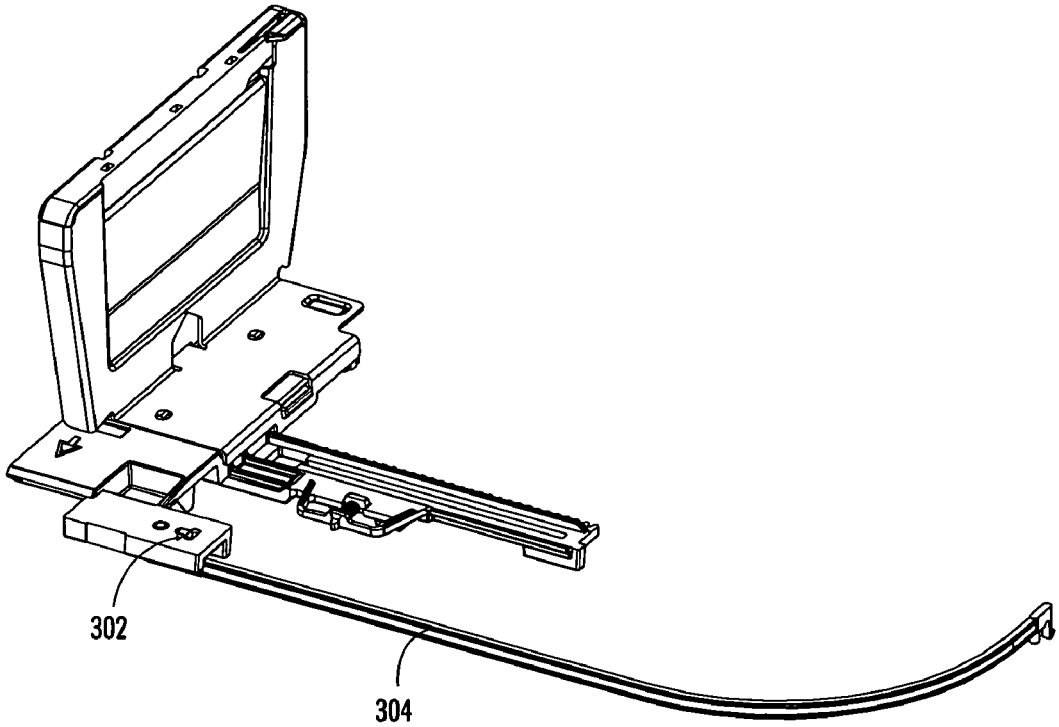
FIG. 3 shows a three dimensional view showing in detail the sheet cassette with the snap fit and flexible pushrod according to the exemplary embodiment of this invention.
Figure 4:
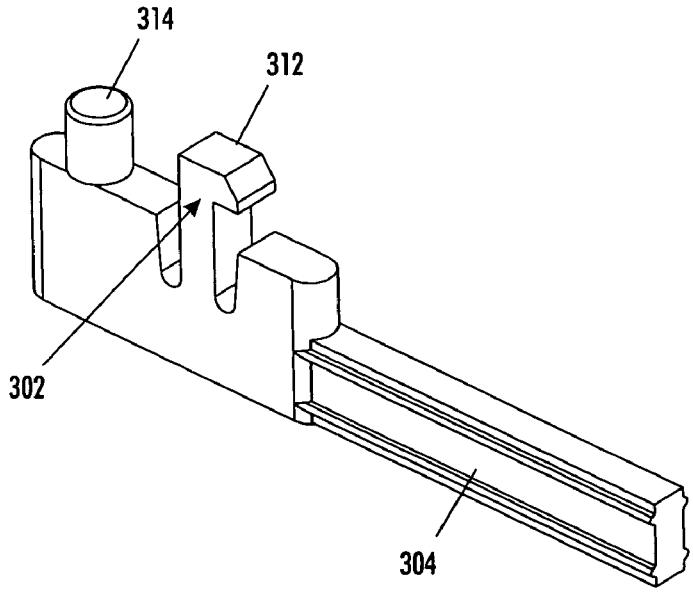
FIG. 4 shows in detail the snap fit and flexible pushrod according to the exemplary embodiment of this invention.

To overcome this problem, the invention thus provides the actuator as shown in FIGS. 2–4 that focuses on the mechanical interface between the position of the side guides 212, 214 and the slide plate 202. In particular, the actuator adapts the position of the side guide 212 for conventional sheet size detection with a number of arms 206 that interact with the flags that activate the sensors or switches of the circuit board. The actuator can thus be applied to any cassette or device in order to detect multiple sheets.

The actuator mechanism 300, according to an exemplary embodiment of this invention includes a snap fit 302, a rod 304 and a channel 306. By using the actuator mechanism 300, the side guide 212 directly moves the slide plate 202 using one piece (i.e., a rod 304) that is connected to both the side guide 212 and slide plate 202.

As shown in FIGS. 3 and 4, the snap fit 302 includes a combination of a hook 312 and a positioning member 314. The hook 312 and the positioning member 314 together connect the snap fit 302 to the side guide 212 and prevents the snap fit 302 from moving independently relative to the side guide 212. As should be appreciated, any single device or combination currently available or later developed can be used to connect the snap fit 302 to the side guide 212 and prevent movement of the snap fit 302 independently relative from the side guide 212. For example, a screw and a screw hole can be used in place of the snap fit 302.

The rod 304 is integral with or connected to the snap fit 302 at one end thereof. The rod 304 is also integral with or connected to the slide plate 202 at another end thereof. The rod 304 is directly connected to both the side guide 212 and the slide plate 202 such that when the side guide 212 is moved in the direction indicated by arrow 106 by a given amount, the slide plate 202 also moves in the direction indicated by arrow 104 by the same amount. Conversely, when the side guide 212 is moved in the direction indicated by arrow 108 by a given amount, the slide plate 202 also moves in the direction indicated by arrow 102 by the same amount.

Positioning accuracy of the slide plate 202 relative to the side guide 212 is thus improved because of the direct transfer of movement. Costs related to sheet size determination is also reduced by using only the snap fit 302 and rod 304. By using the rod 304 and side guide 212, more focus is given to the mechanical interface between the side guide 212 and the slide plate 202. As should be appreciated, although the motion of only the side guide 212 is discussed, the motion of the other side guide 214 can be used.

Located at the bottom of the cassette 110 is a guide channel 306 that guides the rod 304 located therein. In other exemplary embodiments, the side guide channel also includes overhangs 310 that maintain the rod 304 within the side guide channel 306. One end of the side guide channel 306 starts at a position adjacent to the side guide 212 when the side guide 212 is adjacent to the side frame 118 and extends in the direction indicated by the arrow 106 as shown in FIG. 2. The guide channel 306 ends at a position along the slide plate 202 in the direction indicated by the arrow 104. By placing the rod 304 in the side guide channel 306, play can be reduced because the channel 306 limits the movement of the rod 304. Play is also reduced because only one piece (i.e., the rod) has to be controlled. In other words, the motion of the side guide 212 is directly transmitted and rotated to the slide plate 202. The actuator is also flexible so that it can conform to the geometry of the side guide channel 306 and be less dependent on actual cassette geometry.

Between the center of the rack and pinion connection 210 and the side frame member 116, the guide channel 306 turns. As shown in FIG. 2, the guide channel 306 turns at turn 310 such that the motion of the guide channel 306 is linearly translated and rotated to the slide plate 202. The radius in which the guide channel 306 turns is selected so that the rod 304 moves easily within the guide channel 310 and to efficiently use space within the cassette. In particular, the radius of the turn 310 is set at a minimum value so that the rod 304 can easily move at the turn 310 and to prevent the rod 304 from getting stuck in the guide channel 306. Conversely, the radius of the turn 310 is set at a maximum value in order to efficiently use the space within the cassette 110. As shown in FIG. 2, an approximate right angle is used. However, as should be appreciated, any angle can be used.

As should be appreciated, the rod 304 can be made of any material currently available and later developed such that the rod 304 does not buckle within the guide channel 306, while still flexible enough to move freely within the guide channel 306. The rod 304 can also have any shape or cross section, including the "I" cross section as shown in FIG. 4. Furthermore, the rod 304 can be made of any material and can have any shape or cross section such that the play between the rod 304 and the guide channel 306 is minimized while allowing easy movement of the rod 304.

Thus, according to the present invention, sheet size sensing is greatly improved and reliability is improved because there is only one component (i.e., the rod) is used. Overall size sensing is also improved because substantially all detrimental tolerances that are created by multiple components is removed. Furthermore, overall size sensing is also improved because the relative motion between the guide and slide plate is substantially eliminated.

While this invention has been described in conjunction with various exemplary embodiments, it is to be understood that many alternatives, modifications and variations would be apparent based on the foregoing description. Accordingly, the exemplary embodiments of this invention, as set forth above are intended to be illustrative, and not limiting. Various changes can be made without departing from the spirit and scope of this invention.

What is claimed is:

1. A sheet cassette, comprising:

a guide member that is placed on a side of a sheet and is movable between a first position and a second position;

a sheet size detector that detects a position of the guide member and is movable between a third position and a fourth position; and a one-piece connector with two ends, wherein a first end of the connector is connected to the guide member and a second end of the connector is connected to the sheet size detector, wherein (a) when the guide member moves between the first position and the second position by a distance, the one-piece connector moves the sheet size detector between the third position and the fourth position by the distance, and (b) the connector transmits and rotates a movement of the guide member.

2. The sheet cassette of claim 1, wherein the movement of the guide member between the first position and the second position is perpendicular to the movement of the sheet size detector between the third position and the fourth position.

3. The sheet cassette of claim 1, wherein the connector is placed in a guide channel that is attached to a bottom surface of the cassette.

4. The sheet cassette of claim 3, wherein the guide channel includes overhangs that prevent the connector for moving out of the guide channel.

5. The sheet cassette of claim 1, wherein the first end of the connector includes a snap fit that locks the connector to the guide member.

6. The sheet cassette of claim 1, wherein the first end of the connector includes a hook and a positioning member that locks the connector to the guide member.

7. The sheet cassette of claim 1, wherein the connector has an I-cross section.

8. The sheet cassette of claim 1, wherein the sheet size detector includes a slide plate and the one-piece connector moves the slide plate of the sheet size detector between the third position and the fourth position in order to interact with a select plurality of switches.

9. A reproduction system comprising the sheet cassette according to claim 1.

10. A method of assembling a sheet cassette, comprising:

placing a guide member in a body of the cassette, wherein the guide member is placed on a side of a sheet and is movable between a first position and a second position;

placing a sheet size detector on the body of the cassette in order to detect a position of the guide member, wherein the sheet size detector is movable between a third position and a fourth position; and connecting a first end of a one-piece connector to the guide member and a second end of the connector to the sheet size detector, wherein (a) when the guide member moves between the first position and the second position by a distance, the one-piece connector moves the sheet size detector between the third position and the fourth position by the distance, and (b) the connector transmits and rotates a movement of the guide member.

11. The method of claim 10, wherein the movement of the guide member between the first position and the second position is perpendicular to the movement of the sheet size detector between the third position and the fourth position.

12. The method of claim 10, wherein the connector is placed in a guide channel that is attached to a bottom surface of the sheet cassette.

13. The method of claim 12, wherein overhangs are placed on top of the guide channel in order to prevent the connector for moving out of the guide channel.

14. The method of claim 10, wherein the connector is snap fitted to the guide member.

15. The method of claim 10, wherein the connector is connected to the guide member by a hook and a positioning member that locks the connector to the guide member.

16. The method of claim 10, wherein the sheet size detector includes a slide plate and the one-piece connector moves the slide plate of the sheet size detector between the third position and the fourth position in order to interact with a select plurality of switches.

* * * * *